US006328187B2

(12) United States Patent
Sugita

(10) Patent No.: US 6,328,187 B2
(45) Date of Patent: Dec. 11, 2001

(54) SUIT HANGERS

(75) Inventor: Haruo Sugita, Tokyo (JP)

(73) Assignee: Taya Company Limited, Tokyo (JP)

( * ) Notice: Subject to any disclaimer, the term of this patent is extended or adjusted under 35 U.S.C. 154(b) by 0 days.

(21) Appl. No.: 09/784,781

(22) Filed: Feb. 15, 2001

Related U.S. Application Data

(62) Division of application No. 09/449,921, filed on Dec. 2, 1999, now Pat. No. 6,244,479.

(30) Foreign Application Priority Data

Dec. 18, 1998 (JP) ..... 10-360394

(51) Int. Cl.[7] ..... A47G 25/14; A47G 25/40
(52) U.S. Cl. ..... 223/94; 223/85
(58) Field of Search ..... 223/85, 92, 89, 223/94, 90, 88

(56) References Cited

U.S. PATENT DOCUMENTS

| | | | | |
|---|---|---|---|---|
| 1,097,889 | | 5/1914 | Sommer . | |
| 2,409,269 | * | 10/1946 | Gersohn | 223/94 |
| 2,413,221 | | 12/1946 | Elston . | |
| 2,436,314 | * | 2/1948 | Lesavoy | 223/94 |
| 2,448,234 | * | 8/1948 | Pandele | 223/94 |
| 2,712,890 | | 7/1955 | Schaefer . | |
| 3,082,921 | | 3/1963 | Sadowsky . | |
| 4,114,786 | | 9/1978 | Wiese . | |
| 4,186,857 | | 2/1980 | Helms, Jr. . | |
| 4,645,106 | | 2/1987 | Pawl . | |
| 4,988,021 | | 1/1991 | Adams et al. . | |
| 5,183,190 | | 2/1993 | Zuckerman . | |
| 5,383,584 | | 1/1995 | Adams . | |
| 5,397,037 | | 3/1995 | Ozawa . | |
| 5,480,076 | | 1/1996 | Siegel et al. . | |
| 5,690,257 | | 11/1997 | Ward . | |

* cited by examiner

*Primary Examiner*—Bibhu Mohanty
(74) *Attorney, Agent, or Firm*—Alan Kamrath; Rider, Bennett, Egan & Arundel, LLP

(57) ABSTRACT

A suit hanger includes a hook having a straight portion and a frame connected to the hook. The frame has an articulating section in a middle thereof, thereby allowing the frame to be folded at the articulating section along a pivotal axis that is at an angle with an extending direction of the straight portion of the hook.

20 Claims, 13 Drawing Sheets

SUIT HANGERS

CROSS REFERENCE

This application is a division of U.S. application Ser. No. 09/449,921 filed Dec. 2, 1999, now U.S. Pat. No. 6,244,479.

BACKGROUND OF THE INVENTION

1. Field of the Invention

The present invention relates to suit hangers, and more particularly to suit hangers of the type having a foldable neck to allow easy use.

2. Description of the Related Art

When using a suit hanger for hanging up a sweater or T-shirt that has a narrow neck hole, one of two shoulder portions of the suit hanger is firstly inserted into the neck hole and then the other. Yet, it is common that the hook of the suit hanger is stuck in the neck and thus difficult to complete insertion of the other shoulder portion into the neck hole. In addition, the neck hole might be permanently enlarged if the suit hanger is forcibly inserted into the neck hole. A method for avoiding such problems is to insert the suit hanger from a bottom hole of the sweater or T-shirt, yet it is troublesome. For a place for selling or display of clothes, frequent hanging up/taking off of the clothes onto/from suit hangers must be completed as soon as possible.

The present invention is intended to provide suit hangers of the type having a foldable a neck to mitigate and/or obviate the above problems.

SUMMARY OF THE INVENTION

It is a primary object of the present invention to provide an improved suit hanger having a neck that can be folded along an axis for easy insertion of shoulders of the suit hanger into the neck hole of a sweater or T-shirt. The suit hanger, including the neck and the shoulders, is made of metal (e.g., steel) and covered by resin to prevent falling of the sweater or T-shirt. Thus, the suit hanger can be used for knitwear. Alternatively, the suit hanger can be integrally formed from plastic material. A card with a trademark or manufacturer name thereon may be attached to the swivel hook of the suit hanger.

Other objects, advantages, and novel features of the invention will become more apparent from the following detailed description when taken in conjunction with the accompanying drawings.

DETAILED DESCRIPTION OF THE PREFERRED EMBODIMENTS

The invention will be explained below with reference to FIGS. 1 through 21.

Figure 1:
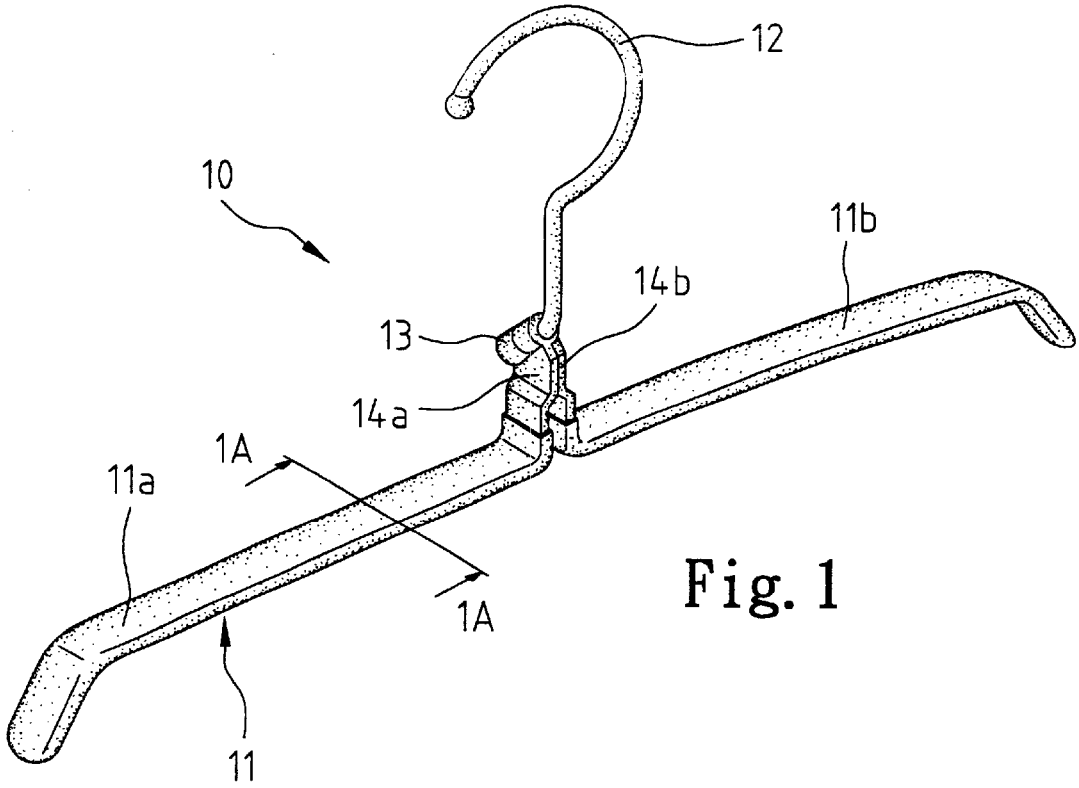
FIG. 1 is a perspective view of a first embodiment of a suit hanger in accordance with the present invention.
Figure 2:
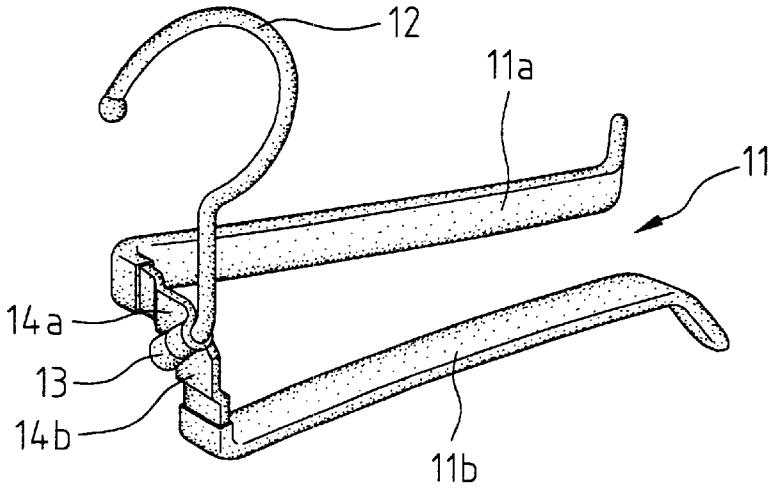
FIG. 2 is a perspective view of the suit hanger in FIG. 1, wherein the suit hanger is in a folded status.
Figure 1A:
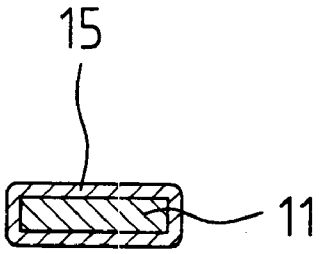
FIG. 1A is a sectional view taken along line 1A—1A of FIG. 1.
Figure 1B:
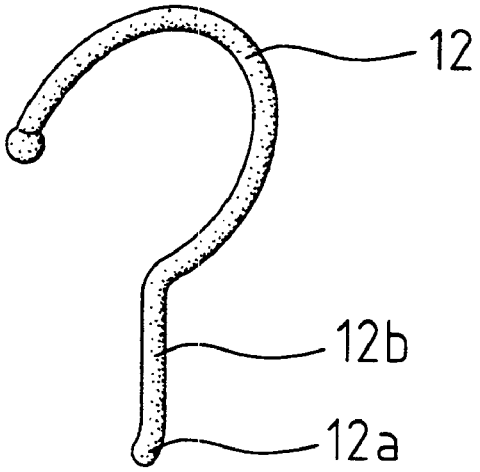
FIG. 1B is a perspective view of a swivel hook of the suit hanger in FIG. 1.
Figure 3:
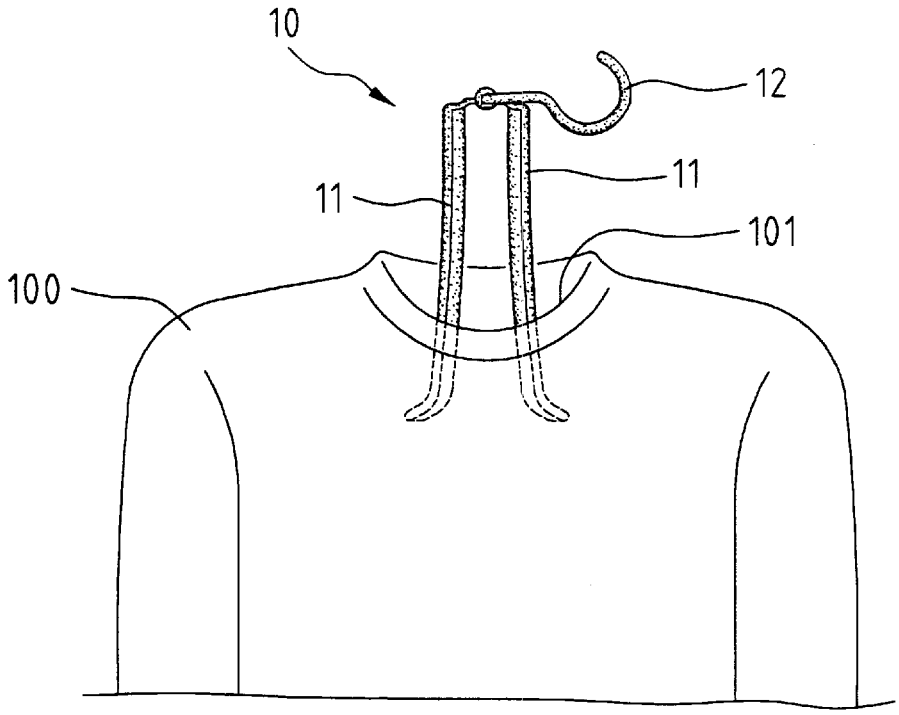
FIG. 3 is a schematic view illustrating insertion of the suit hanger in FIG. 1 into a neck hole of upper wear.
Figure 4:
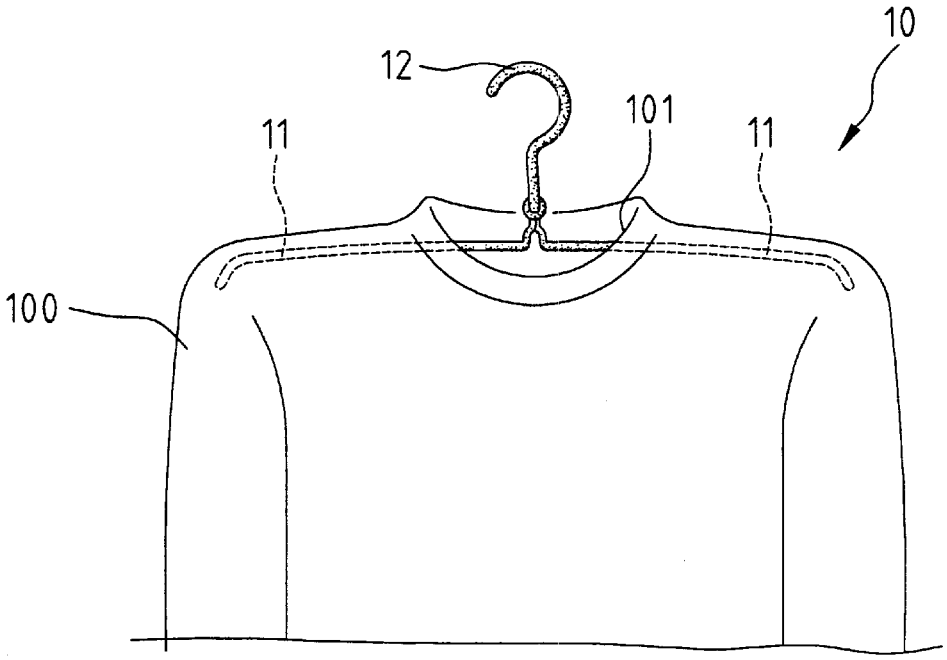
FIG. 4 is a view similar to FIG. 3, wherein the suit hanger is in an extended status.
Figure 5:
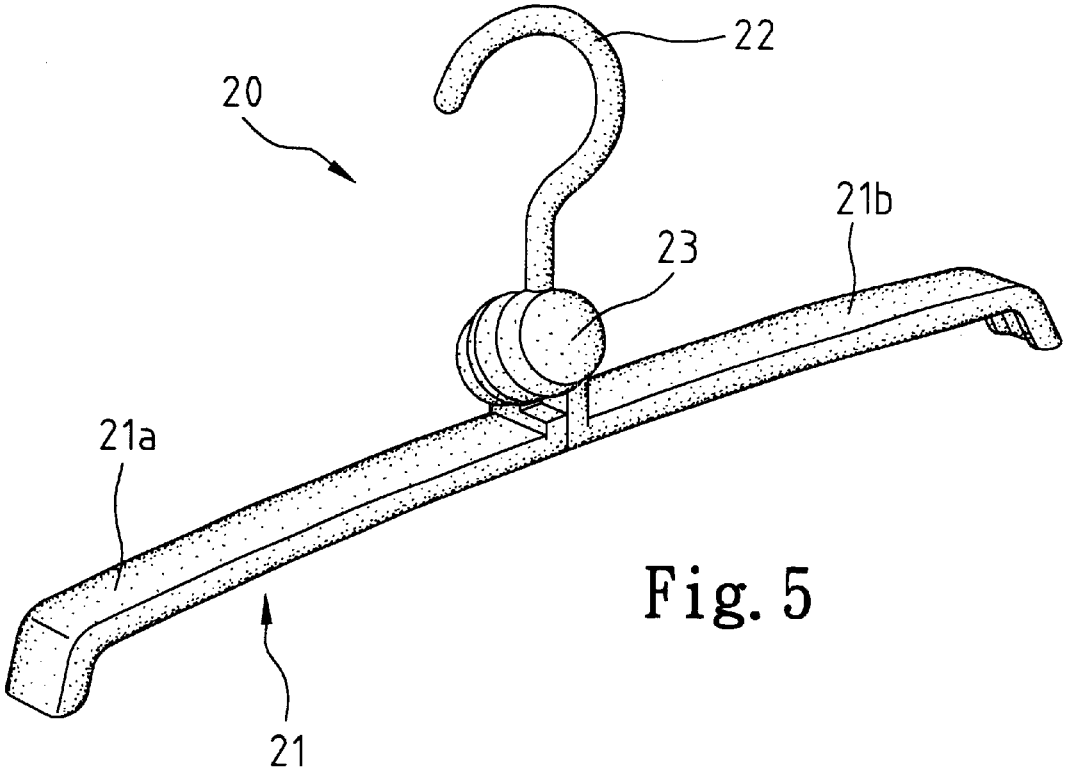
FIG. 5 is a perspective view of a second embodiment of the suit hanger in accordance with the present invention.

Referring to FIG. 1, a first embodiment of a suit hanger 10 in accordance with the present invention generally includes a frame 11 consisting of two shoulders 11*a* and 11*b* and a swivel hook 12. Each shoulder 11*a*, 11*b* includes a neck 14*a*, 14*b* extended from an inner end thereof, each neck 14*a*, 14*b* having a distal end articulated at 13. In this embodiment, each neck 14*a*, 14*b* is pivotally mounted about a pintle section 12*a* (FIG. 1B) of the swivel hook 12. The pintle section 12*a* is at an angle (preferably 45°) with a straight portion 12*b* of the swivel hook 12. As illustrated in FIG. 1, the articulating section 13 formed by the necks 14*a* and 14*b* and the pintle 12*a* of the swivel hook 12 extends along a direction that is at an angle (preferably 45°) with a horizontal plane. As a result, the necks 14*a* and 14*b* may pivot about the pintle section 12*a* of the swivel hook 12, i.e., shoulder 11*a* may be pivoted to a position shown in FIG. 2, thereby allowing easy insertion of the suit hanger into the neck hole 101 of upper wear 100 (FIG. 3). Next, shoulders 11*a* and 11*b* are returned to their straight positions for hanging up the upper wear 100. The frame 11 may be made of steel and covered by resin 15 (FIG. 1A) by means of immersing the frame 11 in a resin solution. Thus, the upper wear is less likely to slide down along the shoulders 11*a* and 11*b*, which is advantageous for knitwear. Removal of the suit hanger from the upper wear can be easily achieved by reversing the above steps. Undesired enlargement of the neck hole is thus avoided. The articulating section 13 of the suit hanger 10 is located in a center of the suit hanger 10 and thus avoids undesired swaying of the suit hanger when the suit hanger is in its extended status.

Referring to FIGS. 5 through 8, a second embodiment of a suit hanger 20 in accordance with the present invention is made of plastic material and generally includes a frame 21 consisting of two shoulders 21*a* and 21*b* and a swivel hook 22. Each shoulder 21*a*, 21*b* includes a neck 24*a*, 24*b* extended from an inner end thereof, each neck 24*a*, 24*b* having a distal end articulated at 23. A pivotal axis of the articulating section 23 is at an angle (preferably 45°) with a straight portion 22*b* (FIG. 8) of the swivel hook 22. In this embodiment, neck 24*a* has a pivotal member 25 formed on the distal end thereof and neck 24*b* has a pivotal member 26 formed on the distal end thereof. The swivel hook 22 is freely rotatably mounted to the pivotal member 26. The pivotal member 25 includes an annular groove 25*a*, a tapered engaging end 25*b*, and at least two slits 25*c*. The slits 25*c* extend in the tapered engaging end 25*b* and a bottom wall defining the annular groove 25*a* and provides resiliency, thereby allowing easy assembly of the pivotal member 26 to the pivotal member 25. The pivotal member 26 is hollow and includes an inner flange 26*a* so as to be snapped into the annular groove 25*a* (FIG. 7) with the tapered engaging end 25*b* rotatably engaged in a complimentary compartment 26*b* in the pivotal member 26, thereby allowing relative pivotal movements between the pivotal members 25 and 26. An end wall 25*d*, 26*c* (FIG. 7) of pivotal member 25, 26 may be omitted.

Figure 6:
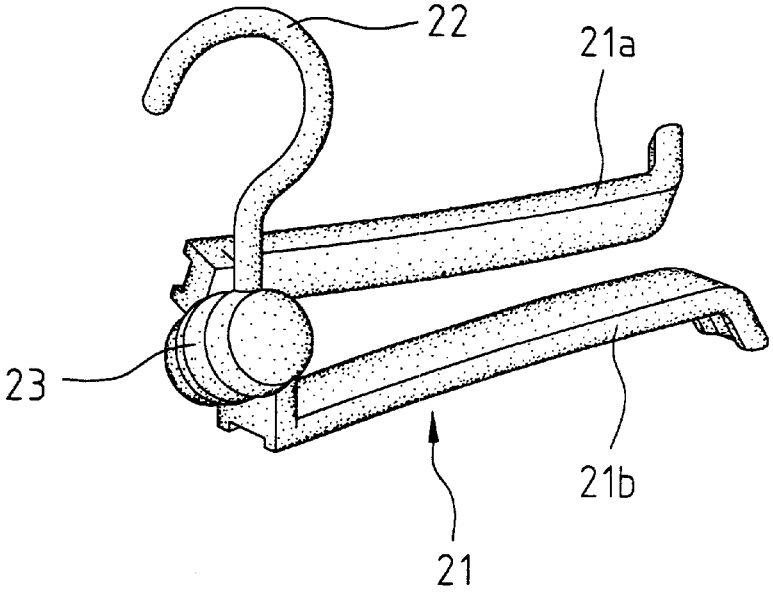
FIG. 6 is a perspective view of the suit hanger in FIG. 5, wherein the suit hanger is in a folded status.
Figure 7:
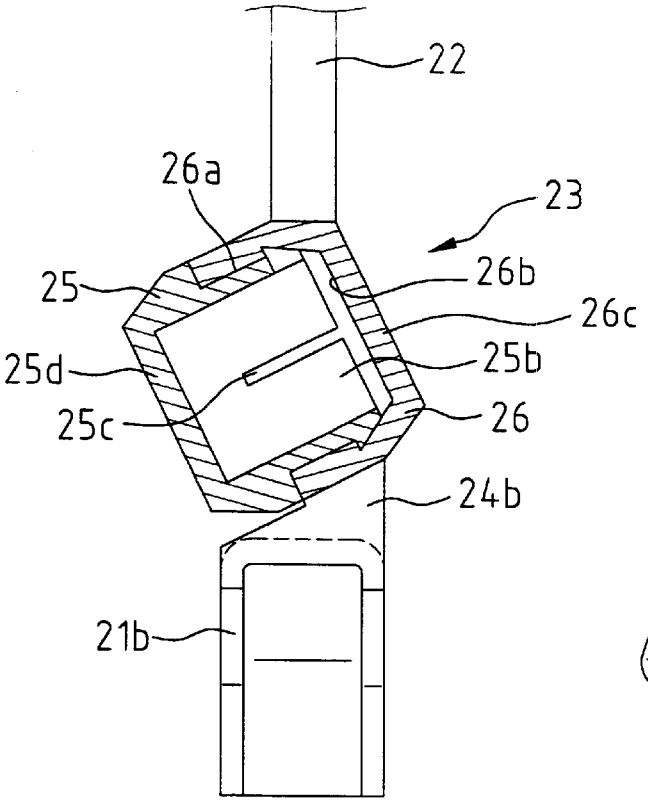
FIG. 7 is a sectional view illustrating a neck area of the suit hanger in FIG. 5.
Figure 8:
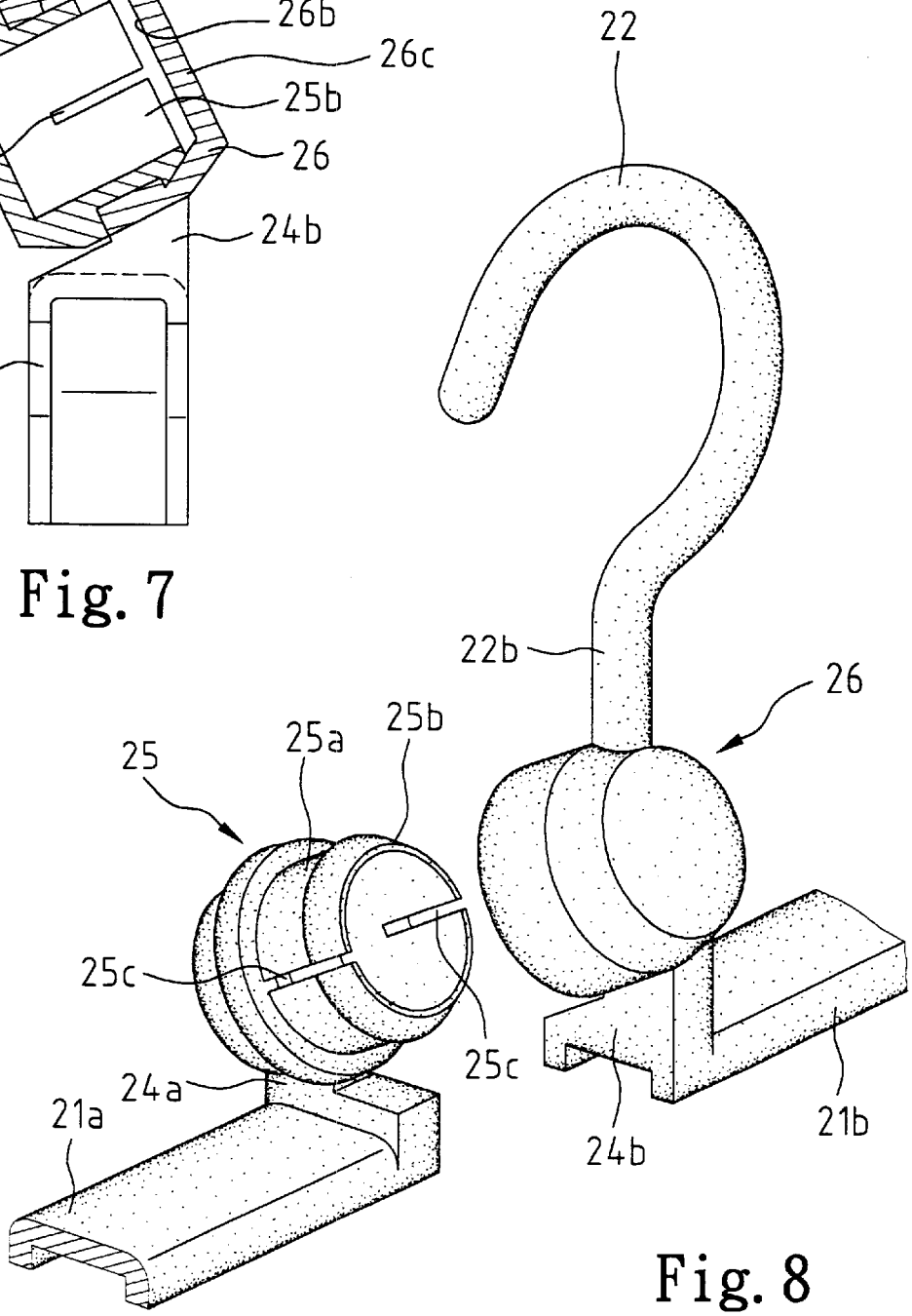
FIG. 8 is an exploded perspective view of a portion of the suit hanger in FIG. 5.

By such an arrangement, shoulder 21*a* may be pivoted to a position shown in FIG. 6, thereby allowing easy insertion of the suit hanger into the neck hole of upper wear. Use of the suit hanger in this embodiment is identical to that in the first embodiment.

Figure 9:
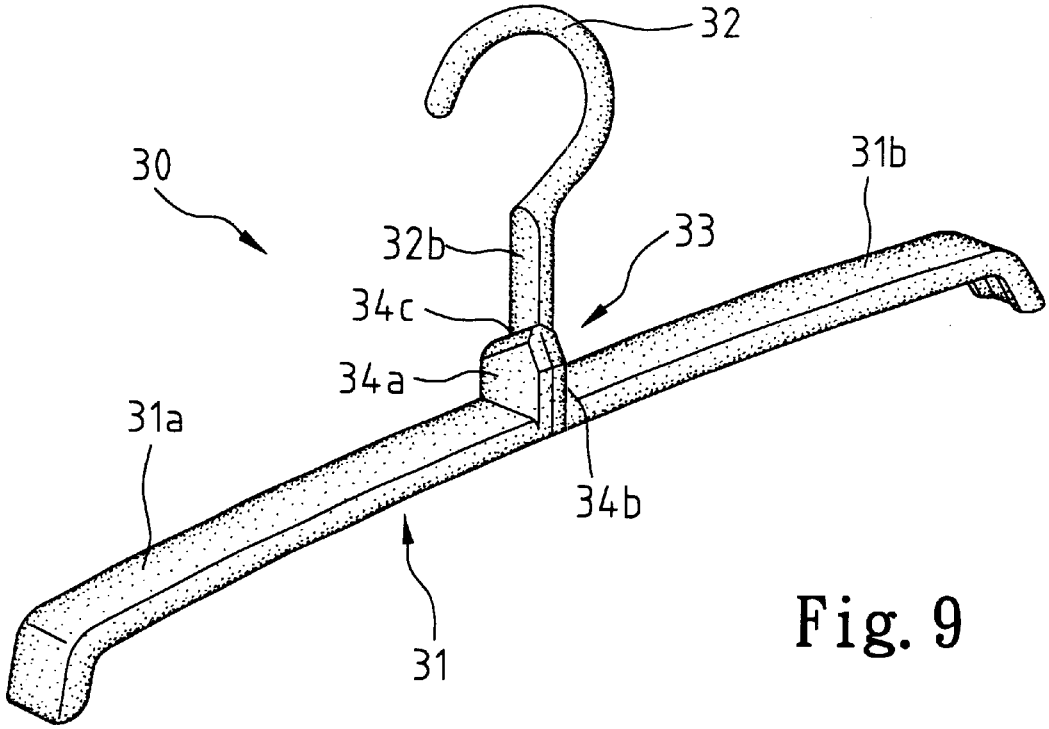
FIG. 9 is a perspective view of a third embodiment of the suit hanger in accordance with the present invention.
Figure 10:
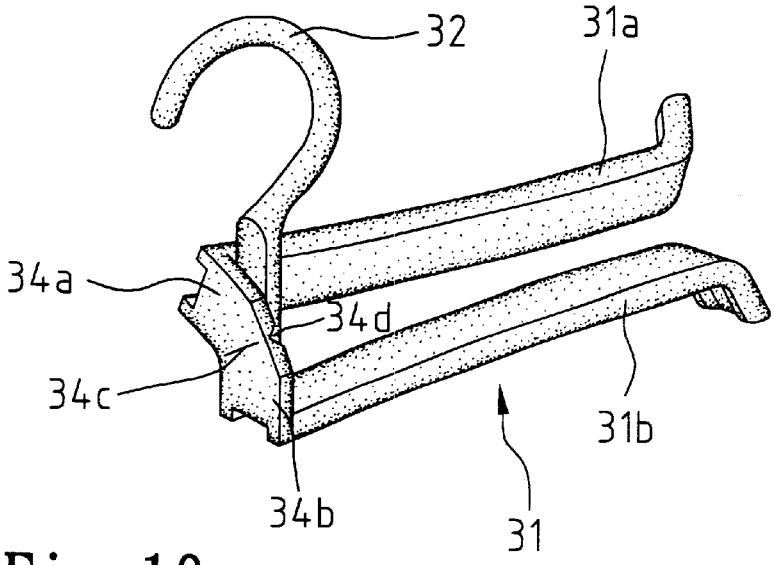
FIG. 10 is a perspective view of the suit hanger in FIG. 9, wherein the suit hanger is in a folded status.

Referring to FIGS. 9 and 10, a third embodiment of a suit hanger 30 in accordance with the present invention is made of plastic material and generally includes a frame 31 consisting of two shoulders 31*a* and 31*b* and a swivel hook 32. Each shoulder 31*a*, 31*b* includes a neck 34*a*, 34*b* extended from an inner end thereof. The necks 34*a* and 34*b* are interconnected by a bendable junction 34*c* therebetween. The junction 34*c* is a thin, flat member with a V-shape notch 34*d* defined in one side thereof to thereby form an articulating section 33 that has a pivotal axis at an angle (preferably 45°) with a straight portion 32*b* (FIG. 9) of the swivel hook 32. The swivel hook 22 is integrally formed with the neck 34*b*.

By such an arrangement, shoulder 31*a* may be pivoted to a position shown in FIG. 10, thereby allowing easy insertion of the suit hanger into the neck hole of upper wear. Use of the suit hanger in this embodiment is identical to that in the first embodiment.

Figure 11:
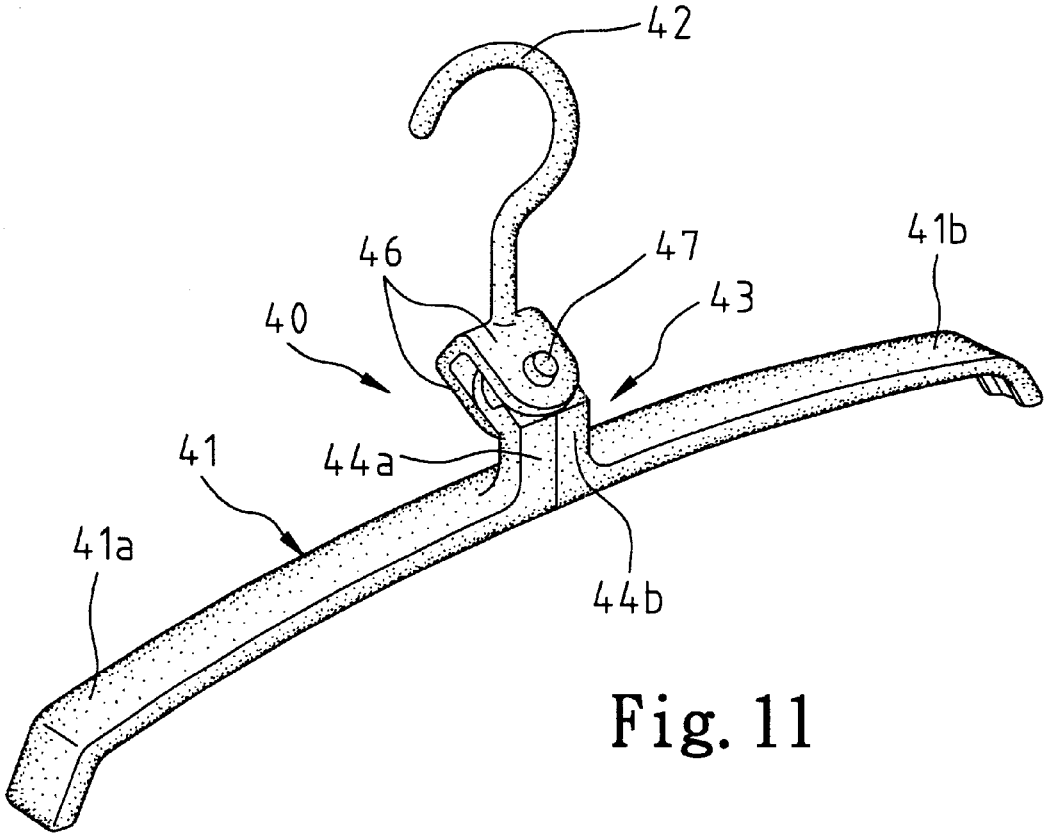
FIG. 11 is a perspective view of a fourth embodiment of the suit hanger in accordance with the present invention.
Figure 12:
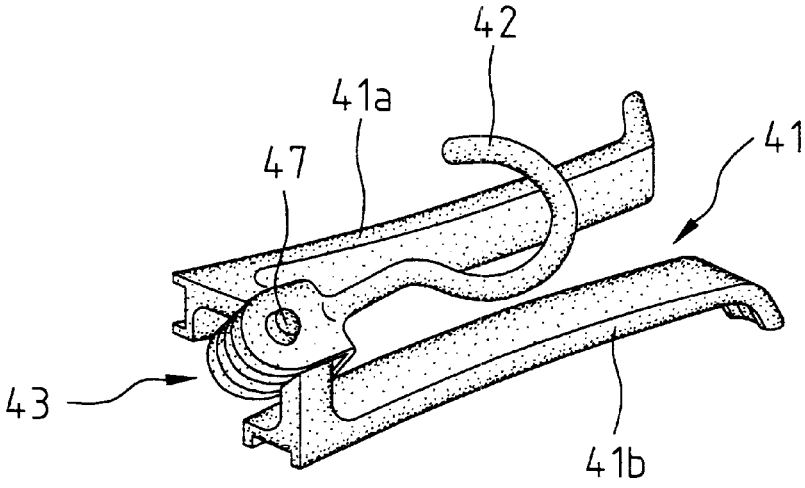
FIG. 12 is a perspective view of the suit hanger in FIG. 11, wherein the suit hanger is in a folded status.
Figure 13:
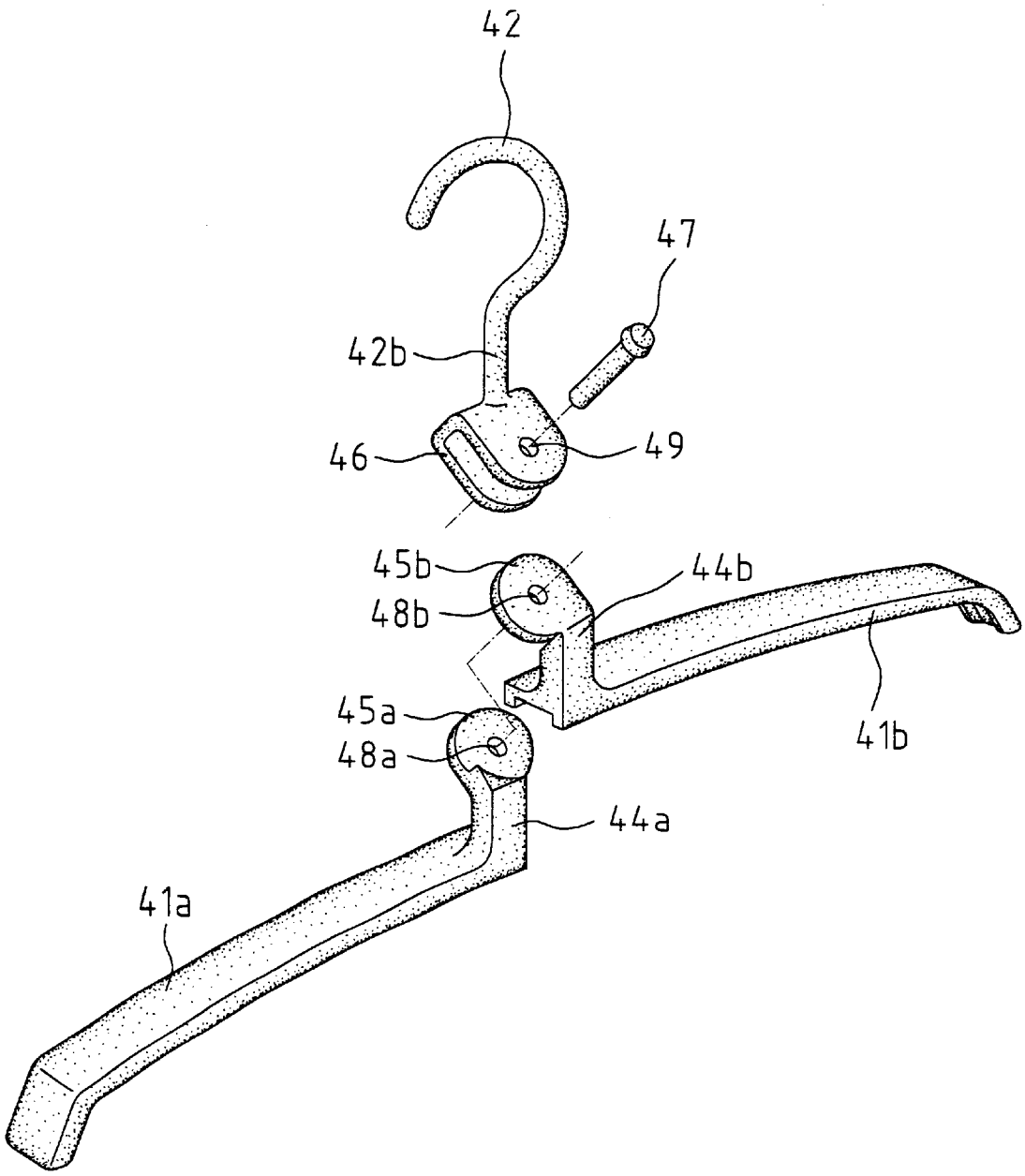
FIG. 13 is an exploded perspective view of the suit hanger in FIG. 11.

Referring to FIGS. 11 through 13, a fourth embodiment of a suit hanger 40 in accordance with the present invention is made of plastic material and generally includes a frame 41 consisting of two shoulders 41*a* and 41*b* and a hook 42. Each shoulder 41*a*, 41*b* includes a neck 44*a*, 44*b* extended from an inner end thereof, each neck 44*a*, 44*b* having a distal end articulated at 43. A pivotal axis of the articulating section 43 is at an angle (preferably 45°) with a straight portion 42*b* (FIG. 13) of the hook 42. In this embodiment, neck 44*a* has a circular member 45*a* with a hole 48*a* formed on the distal end thereof and neck 44*b* has a circular member 45*b* with a hole 48*b* formed on the distal end thereof. The hook 42 includes a substantially U-shape member 46 formed on a distal end of the straight portion 42*b* thereof. The U-shape member 46 has two lateral walls (not labeled) for pivotally receiving the circular members 45*a* and 45*b* by means of extending a pin 47 through aligned holes 49 in the lateral walls of the U-shape member 46 and the holes 48*a* and 48*b*.

By such an arrangement, shoulder 41*a* may be pivoted to a position shown in FIG. 12, thereby allowing easy insertion of the suit hanger into the neck hole of upper wear. Use of the suit hanger in this embodiment is identical to that in the first embodiment.

Figure 14:
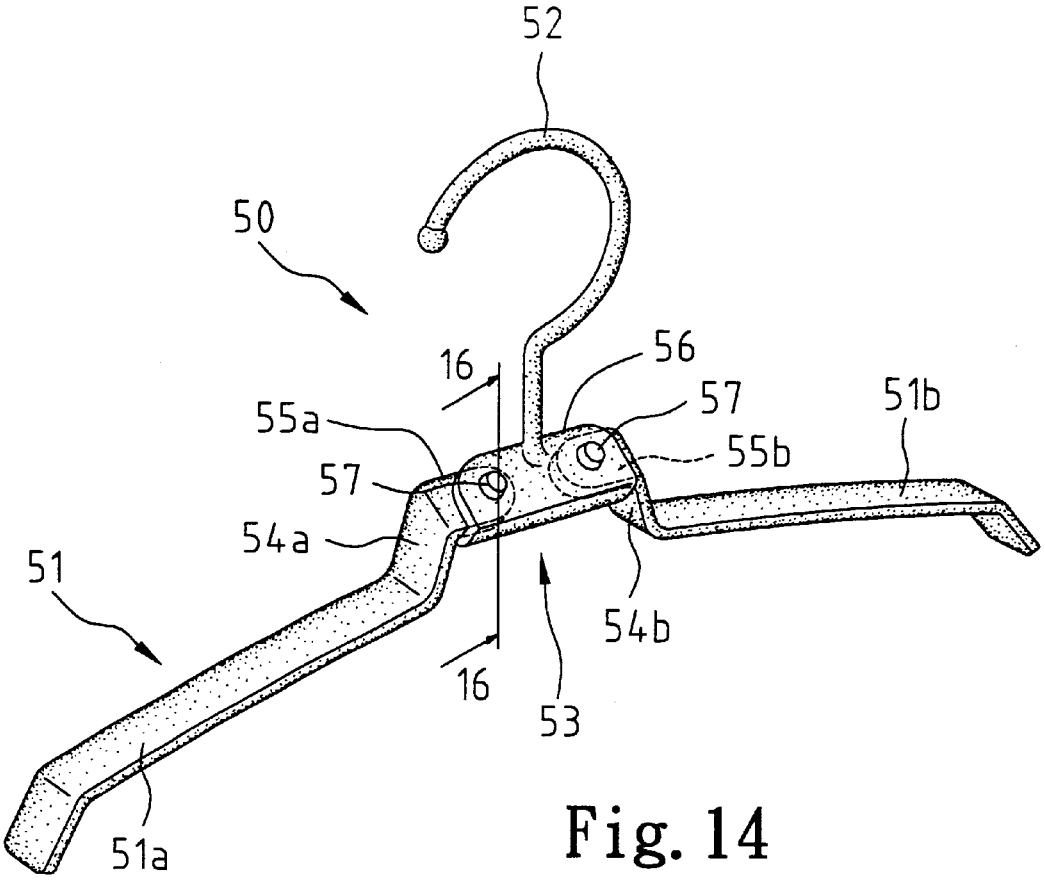
FIG. 14 is a perspective view of a fifth embodiment of the suit hanger in accordance with the present invention.
Figure 15:
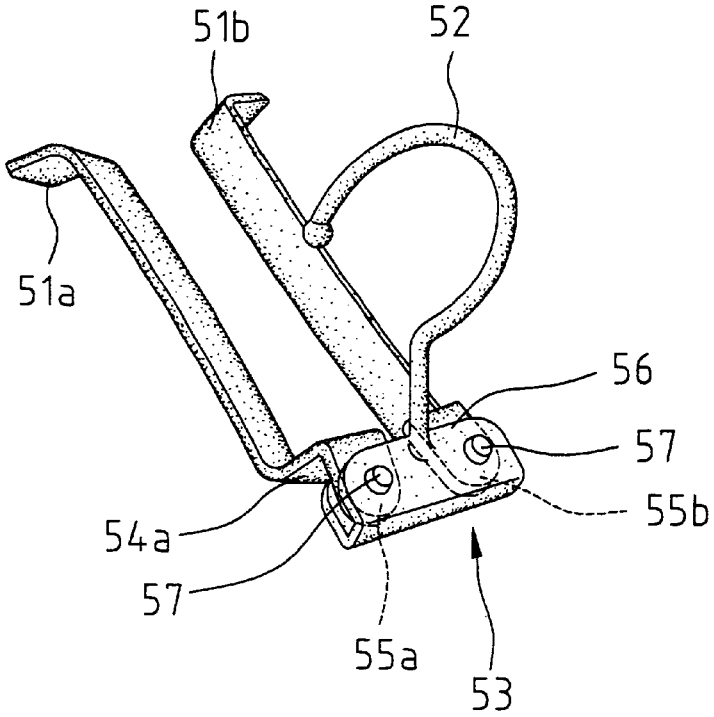
FIG. 15 is a perspective view of the suit hanger in FIG. 14, wherein the suit hanger is in a folded status.
Figure 16:
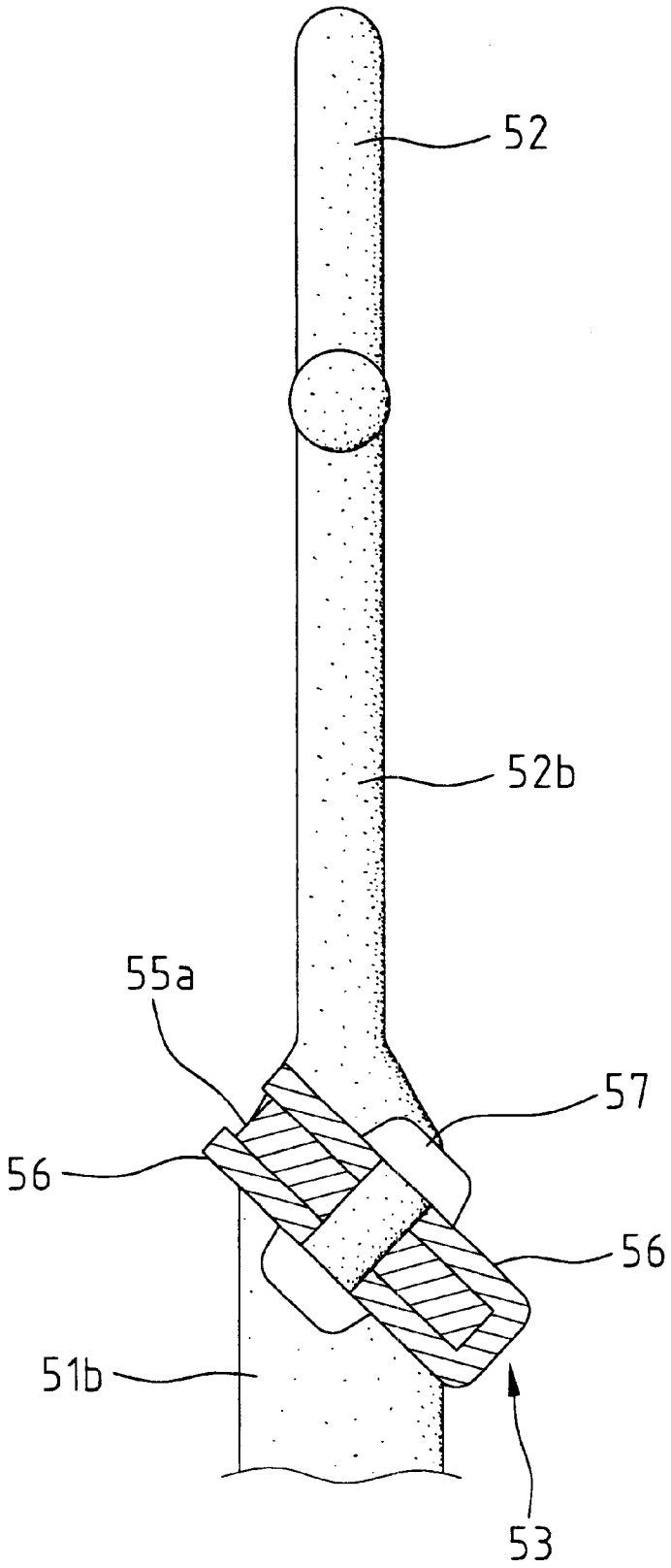
FIG. 16 is a sectional view taken along line 16—16 in FIG. 14.
Figure 17:
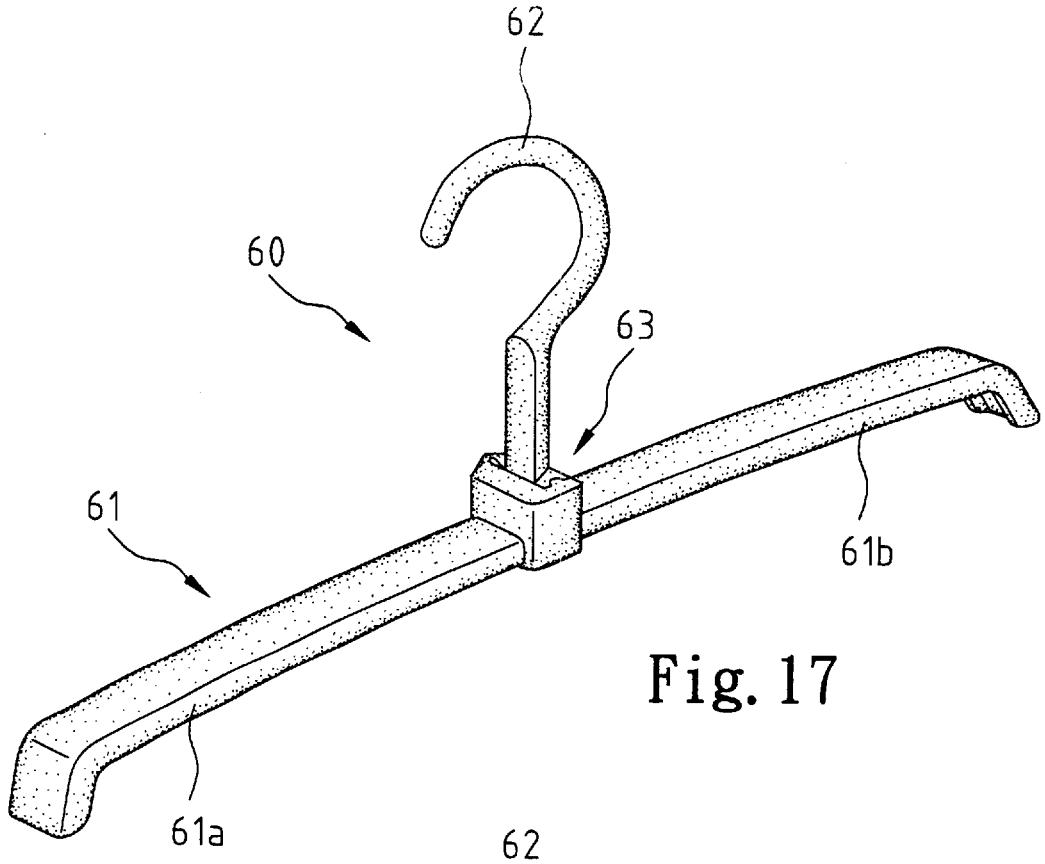
FIG. 17 is a perspective view of a sixth embodiment of the suit hanger in accordance with the present invention.
Figure 18:
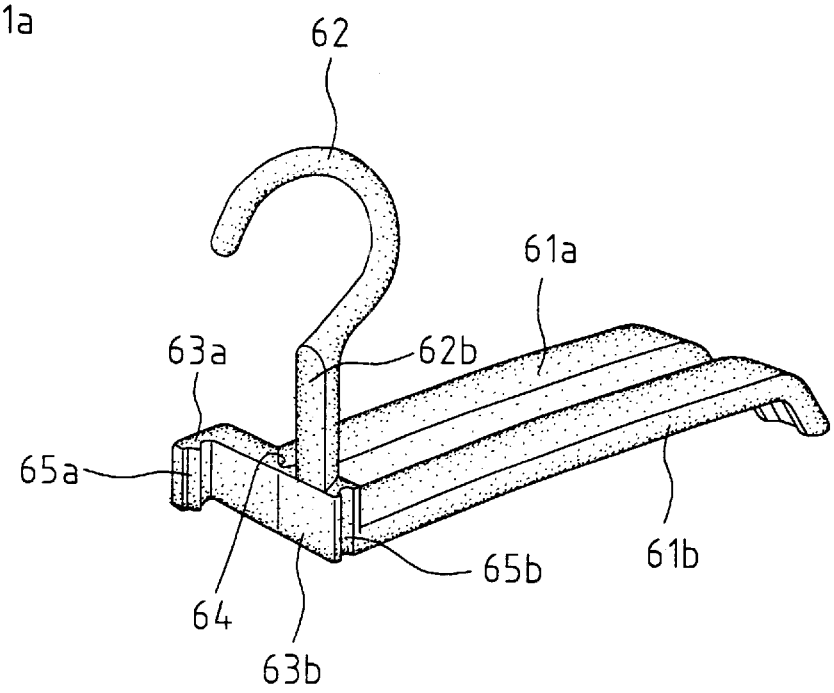
FIG. 18 is a perspective view of the suit hanger in FIG. 17, wherein the suit hanger is in a folded status.
Figure 19:
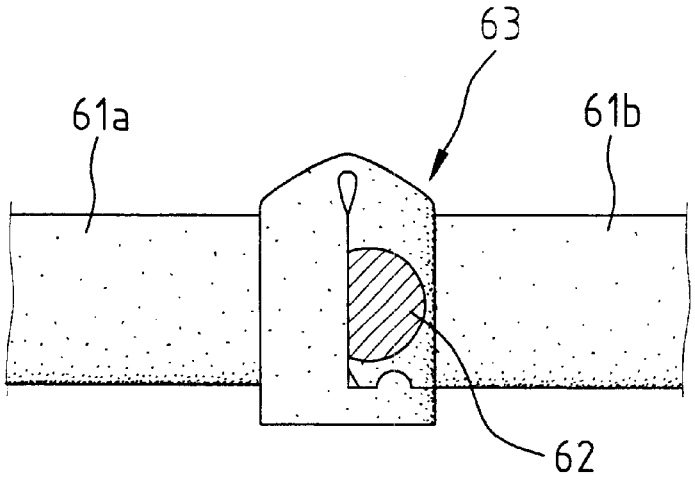
FIG. 19 is a top view, partly sectioned, illustrating a neck area of the suit hanger in FIG. 17.
Figure 20:
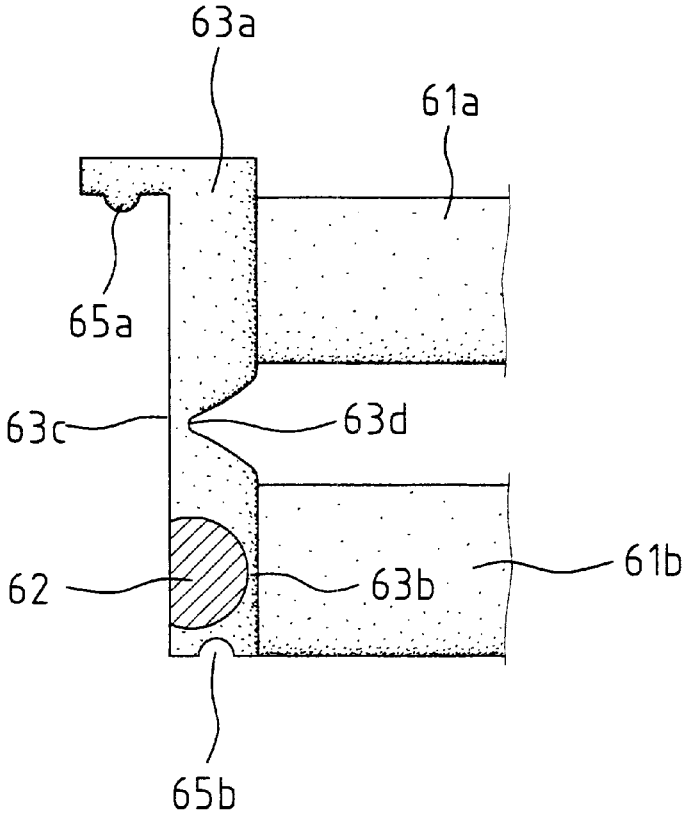
FIG. 20 is a top view similar to FIG. 19, wherein the suit hanger is in a folded status.

Referring to FIGS. 14 through 16, a fifth embodiment of a suit hanger 50 in accordance with the present invention is made of steel and generally includes a frame 51 consisting of two shoulders 51*a* and 51*b* and a hook 52. As described in the first embodiment, the frame 51 may be covered by a layer of resin. Each shoulder 51*a*, 51*b* includes a neck 54*a*, 54*b* extended from an inner end thereof, each neck 54*a*, 54*b* having a horizontal extension 55*a*, 55*b* extended from a distal end thereof. The extensions 55*a* and 55*b* are articulated at 53. In this embodiment, the hook 52 includes a substantially U-shape member 56 formed on a distal end of a straight portion 52*b* thereof. The U-shape member 56 has two lateral walls (not labeled) defining a compartment therebetween for pivotally receiving the extensions 55*a* and 55*b*. Two pins 57 are provided to pivotally retain the extensions 55*a*, 56*a* (FIG. 16) in the compartment of the U-shape member 56. A pivotal axis of each extension 55*a*, 55*b* is at an angle (preferably 45°) with the straight portion 52*b* (FIG. 16) of the hook 52.

By such an arrangement, shoulder 51*a* may be pivoted to a position shown in FIG. 15, thereby allowing easy insertion of the suit hanger into the neck hole of upper wear. Use of the suit hanger in this embodiment is identical to that in the first embodiment.

Referring to FIGS. 17 through 20, a sixth embodiment of a suit hanger 60 in accordance with the present invention is made of plastic material and generally includes a frame 61 consisting of two shoulders 61*a* and 61*b* and a hook 62. Shoulder 61*a* includes an end that is articulated to an end of shoulder 61*b* at an articulating section 63. A pivotal axis of the articulating section 63 is parallel to an extending direction of a straight portion 62*b* (FIG. 18) of the hook 62. In this embodiment, the articulating section 63 includes a first half 63*a* on the shoulder 61*a* and a second half 63*b* on the shoulder 61*b*, the first half 63*a* and the second half 63*b* being interconnected by a thin, flat bendable section 63*c* (FIG. 20) with a V-shape notch 63*d* defined in one side thereof.

By such an arrangement, shoulder 61*a* may be pivoted to a position shown in FIG. 12, thereby allowing easy insertion of the suit hanger into the neck hole of upper wear. Use of the suit hanger in this embodiment is similar to that in the first embodiment, except for that the shoulders 61*a* and 61*b* may pivot horizontally to allow easier use. In addition, the first half 63*a* has a protrusion 65*a* and the second half 63*b* has a groove 65*b* for releasably receiving the protrusion 65*a* (see FIGS. 19 and 20).

Figure 21:
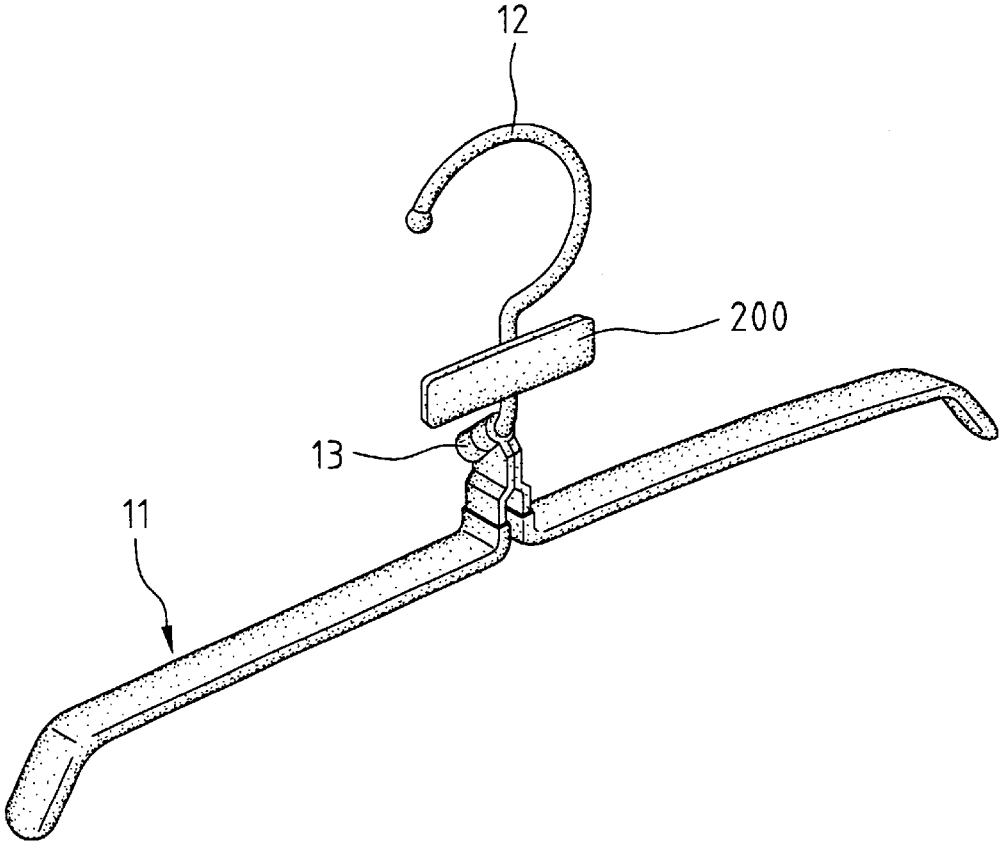
FIG. 21 is a modified embodiment of the suit hanger in accordance with the present invention.

FIG. 21 illustrates a modified embodiment of the suit hanger in accordance with the present invention, wherein a card 200 with a trademark or manufacturer name thereon is attached to the swivel hook 12. It is noted that the card 200 may be attached to any one of the hooks illustrated in all of the embodiments in accordance with the present invention.

According to the above description, it is appreciated that the suit hangers in accordance with the present invention may be inserted into the neck hole of upper wear easily and removal of the suit hanger from the upper wear can be achieved easily by means of the articulating section located in a middle of the suit hanger frame. The suit hangers in accordance with the present invention may be made of plastic material or steel covered by a layer of resin to thereby prevent falling of the upper wear from the suit hangers, which is advantageous to knitwear. Manufacture of the suit hangers of plastic material can be accomplished at a lower cost.

Although the invention has been explained in relation to its preferred embodiment, it is to be understood that many other possible modifications and variations can be made without departing from the spirit and scope of the invention as hereinafter claimed.

What is claimed is:

1. A suit hanger comprising:

a hook having a straight portion; and a frame connected to the hook and having an articulating section in a middle thereof, the frame being foldable at the articulating section along a pivotal axis that is at an angle with an extending direction of the straight portion of the hook, wherein the frame includes two shoulders each having a neck extended from an inner end thereof, and wherein one of the necks includes a first pivotal member formed thereon and having an annular groove and a tapered engaging end, and the other neck includes a second pivotal member having a compartment for receiving the tapered engaging end, thereby allowing relative pivotal movement between the first pivotal member and the second pivotal member and thus forming the articulating section.

2. The suit hanger as claimed in claim 1, wherein the pivotal axis of the articulating section is at an angle of 45° with the extending direction of the straight portion of the hook.

3. The suit hanger as claimed in claim 2, wherein the suit hanger is made of plastic material.

4. The suit hanger as claimed in claim 3, further comprising a card with a trademark or manufacturer name thereon.

5. The suit hanger as claimed in claim 1, wherein the first pivotal member includes at least two slits that extend in the tapered engaging end and a bottom wall defining the annular groove, thereby allowing easy assembly of the second pivotal member to the first pivotal member.

6. The suit hanger as claimed in claim 1, wherein the suit hanger is made of plastic material.

7. The suit hanger as claimed in claim 6, further comprising a card with a trademark or manufacturer name thereon.

8. The suit hanger as claimed in claim 5, wherein the suit hanger is made of plastic material.

9. The suit hanger as claimed in claim 8, further comprising a card with a trademark or manufacturer name thereon.

10. The suit hanger as claimed in claim 1, further comprising a card with a trademark or manufacturer name thereon.

11. The suit hanger as claimed in claim 4, wherein the card is attached to the straight portion of the hook.

12. The suit hanger as claimed in claim 11, wherein the hook extends from the second pivotal member.

13. The suit hanger as claimed in claim 9, wherein the card is attached to the straight portion of the hook.

14. The suit hanger as claimed in claim 13, wherein the hook extends from the second pivotal member.

15. The suit hanger as claimed in claim 7, wherein the card is attached to the straight portion of the hook.

16. The suit hanger as claimed in claim 15, wherein the hook extends from the second pivotal member.

17. The suit hanger as claimed in claim 1, wherein the hook extends from the second pivotal member.

18. The suit hanger as claimed in claim 10, wherein the card is attached to the straight portion of the hook.

19. The suit hanger as claimed in claim 18, wherein the hook extends from the second pivotal member.

20. The suit hanger as claimed in claim 6, wherein the hook extends from the second pivotal member.

* * * * *